US005205489A

United States Patent [19]

Milner

[11] Patent Number: 5,205,489

[45] Date of Patent: Apr. 27, 1993

[54] ADJUSTABLE EDUCTOR

[75] Inventor: Ted D. Milner, Westminster, Colo.

[73] Assignee: Silver Engineering Works, Inc., Aurora, Colo.

[21] Appl. No.: 855,167

[22] Filed: Mar. 20, 1992

Related U.S. Application Data

[63] Continuation of Ser. No. 619,585, Nov. 29, 1990, abandoned.

[51] Int. Cl.[5] ..... B05B 7/14

[52] U.S. Cl. ..... 239/434; 239/654; 406/153

[58] Field of Search ..... 239/8, 310, 318, 434, 239/654, 8; 406/152, 153, 194

[56] References Cited

U.S. PATENT DOCUMENTS

| | | | |
|---|---|---|---|
| 1,028,997 | 6/1912 | Dunn | 406/194 X |
| 2,508,766 | 5/1950 | Morel | 406/153 X |
| 2,907,557 | 10/1959 | Coanda | 239/434 X |
| 3,749,377 | 7/1973 | Slater et al. | 239/434 X |
| 4,186,772 | 2/1980 | Handleman | 406/153 X |

*Primary Examiner*—Andres Kashnikow
*Assistant Examiner*—Kevin P. Weldon
*Attorney, Agent, or Firm*—Robert F. Palermo; Bernard J. Murphy; Walter C. Vliet

[57] ABSTRACT

A body, centrally bored, has a threaded inlet section which threadedly, and adjustably receives a through-bored nozzle. The nozzle has an inner end which intrudes into a transverse passage formed of two, communicating holes formed in the body. The holes ingest fluent material, and the nozzle is selectively locked in a given axial position, in the body, by an internally and externally threaded lock bushing. The bushing threadedly engages an end of the nozzle and is torqued up against the body to hold the nozzle in place.

3 Claims, 1 Drawing Sheet

ADJUSTABLE EDUCTOR

This application is a continuation of application Ser. No. 07/619,585, filed Nov. 29, 1990 now abandoned.

BACKGROUND OF THE INVENTION

This invention pertains to eductors, namely such devices which employ one fluent substance, water, steam, air, or the like, in passage therethrough to ingest another fluent material or substance for the purpose of mixing the two fluent substances or materials together and impel the mix out of the device.

Inductors known in the prior art, commonly, are of one-piece construction, the same having a venturi throat and, consequently, are of fixed configuration. In handling fluent substances, for ingestion, the efficiency of the one-piece, fixed-configuration eductors varies as the viscosity of the ingested substance varies.

An adjustable eductor, i.e., one which can vary the effective area of the fluent material ingesting port or ports, would be more universally applicable in handling varying-viscosity substances and materials.

SUMMARY OF THE INVENTION

It is an object of this invention, then, to set forth just such an adjustable eductor. Particularly, it is an object of this invention to disclose a novel, adjustable eductor comprising a body; a nozzle adjustably positionable within said body; and means for locking said nozzle in a selected position within said body.

Further objects of this invention, as well as the novel features thereof, will become apparent from the following description, taken in conjunction with the accompanying figures.

BRIEF DESCRIPTION OF THE DRAWING FIGURES

DETAILED DESCRIPTION

Figure 1:
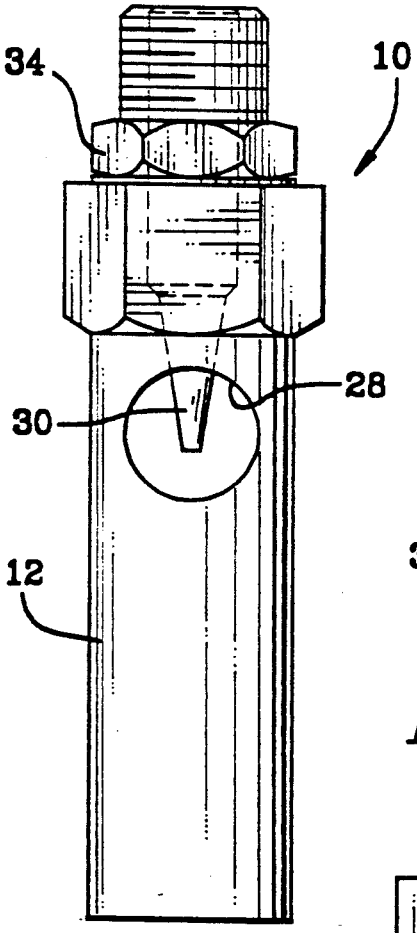
FIG. 1 is a plan view of an embodiment of the novel adjustable eductor.
Figure 6:
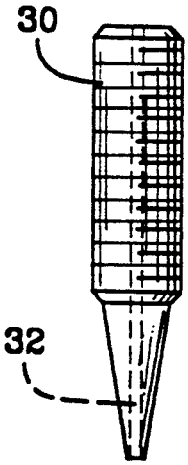
FIG. 6 is a plan view of the nozzle.
Figure 2:
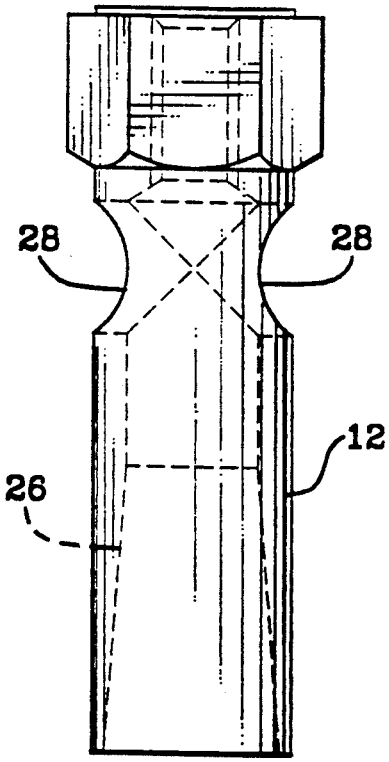
FIG. 2 is a plan view of the body of the eductor of FIG. 1.
Figure 4:
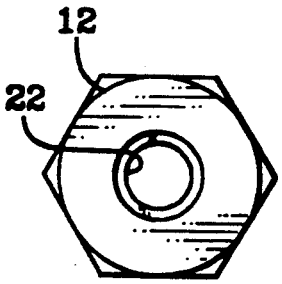
FIG. 4 is an end view of the body, taken from the top of FIG. 2.
Figure 3:
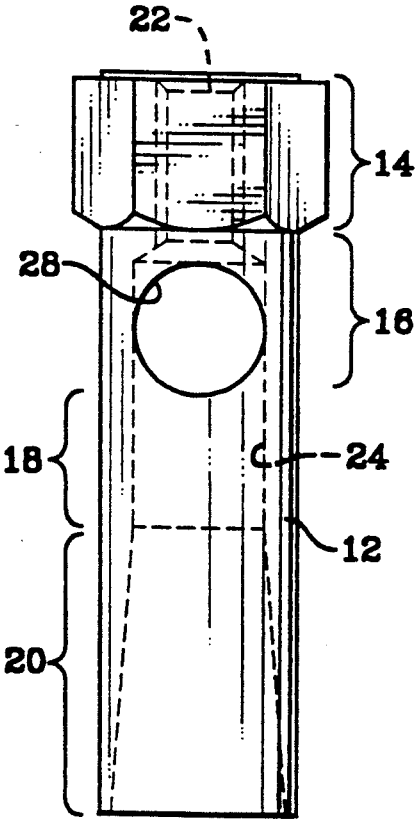
FIG. 3 is a plan view of the body of FIG. 2 rotated ninety degrees of arc about its axis.
Figure 5:
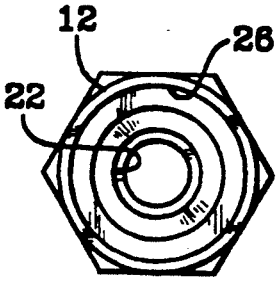
FIG. 5 is an end view of the body, taken from the bottom of FIG. 2.

As shown in the figures, the adjustable eductor 10 has a body 12 consisting of an inlet section 14, a suction section 16, a mixing chamber 18, and a discharge section 20. The inlet section 14 has a straight, tapped bore 22 formed therein. The suction section 16 and mixing chamber 18 have a straight bore 24 formed therein, and the discharge section 20 has an outwardly-flaring or diverging bore 26 formed therein.

Suction section 16 has a pair of holes 28 formed therein, each of a given size, which open onto the inner bore 24 and outwardly of the body 12, the holes being provided for the ingestion of fluent materials or substances.

The body 12 receives a nozzle 30 within the inlet section 14 thereof, the nozzle 30 having external threads for threadedly engaging the threads in the inlet section. The nozzle 30 has a throughgoing bore 32 formed centrally therein.

This invention provides adjustable eductive capacity in order to be capable of optimization regardless of the relative viscosities of the motive fluent material and the fluent material to be ingested.

In circumstances wherein the fluent substance to be ingested is quite viscous, the nozzle 30 can be threadedly advanced to intrude into the transverse passage which the holes 28 form. If the to-be-ingested fluent substance is less viscous, the nozzle can be threadedly retracted into the body to present less intrusion into the aforesaid passage. Self-evidently, intrusion and retraction of the nozzle 30 varies the ingestion effectiveness of the areas of the holes 28 and, in this way, ingestion of the fluent material and substances can be controlled.

Upon the nozzle being threadedly positioned in the body 12 as appropriate for handling a fluent substance of a given viscosity, it can be locked in such position. A lock bushing 34 (FIG. 1) is internally and externally threaded to receive the nozzle 30 therein, and to couple the eductor 10 to a source of motive fluent material, respectively. With the nozzle 30 properly positioned in the body 12, the lock bushing 34 is threaded over the nozzle 30 and torqued tightly against the body 12.

While I have described my invention in connection with a specific embodiment thereof, it is to be clearly understood that this is done only by way of example, and not as a limitation to the scope of the invention as set forth in the objects thereof and in the appended claims.

I claim:

1. An adjustable eductor, comprising:

a body which is bored axially for its full length and which has an internally threaded inlet section for motive fluent material, a suction section with a hole of a given area, formed through a sidewall thereof, for ingesting fluent material into said body, a mixing chamber, a diverging-bore discharge section, and a centrally axially bored nozzle adjustably positionable within said body by means of external threads which engage the threads of the inlet section to provide means for setting the extent of nozzle advancement into, and withdrawal from said suction section, for establishing a rate of ingestion of fluent material through said hole optimized for the viscosity of the fluent material to be ingested, by varying the degree of intrusion of said nozzle across the area of said hole and thereby adjusting the ingestion effectiveness of said hole area.

2. An adjustable eductor, according to claim 1, further comprising:

means for locking said nozzle in a selected position of intrusion within said suction section of said body.

3. An adjustable eductor, comprising:

a body which has an inlet section, a suction section which has an opposed pair of holes formed through its walls which open onto opposite sides of said body, to define a transverse passage into said body for ingesting fluent material into said suction section, a mixing, section, a diverging-bore discharge section, and a nozzle axially positionable within said body; wherein said nozzle comprises means for selectively varying intrusion into, and withdrawal from said passage, for establishing a rate of ingestion of fluent material of a given viscosity through said opposed holes.

* * * * *